United States Patent [19]

Kokkeler et al.

[11] Patent Number: 5,036,172

[45] Date of Patent: Jul. 30, 1991

[54] METHOD AND DEVICE FOR DETERMINING WHEN A FOOD HAS THAWED IN A MICROWAVE OVEN

[75] Inventors: Franciscus Kokkeler, Malnate, Italy; Mats Idebro, Norrköping, Sweden; Enzo Cigarini, Brebbia; Mario Fioroli, Brezzo di Bedero, both of Italy

[73] Assignee: Whirlpool International B.V., Eindhoven, Netherlands

[21] Appl. No.: 410,391

[22] Filed: Sep. 20, 1989

[30] Foreign Application Priority Data

Sep. 23, 1988 [IT] Italy ..... 22062 A/88

[51] Int. Cl.[5] ..... H05B 6/68

[52] U.S. Cl. ..... 219/10.55 M; 219/10.55 B; 219/10.55 E; 374/149; 99/325; 426/243

[58] Field of Search ..... 219/10.55 B, 10.55 R, 219/10.55 E, 10.55 M, 10.55 F, 10.55 D; 374/149; 99/DIG. 14, 451, 325; 426/241, 243, 524

[56] References Cited

U.S. PATENT DOCUMENTS

| | | | |
|---|---|---|---|
| 4,093,841 | 6/1978 | Dills | 219/10.55 E |
| 4,125,752 | 11/1978 | Wegener | 219/10.55 B |
| 4,341,937 | 7/1982 | Staats | 219/10.55 M |
| 4,507,530 | 3/1985 | Smith | 219/10.55 B |
| 4,520,250 | 5/1985 | Ishihara et al. | 219/10.55 B |
| 4,727,799 | 3/1988 | Ohshima et al. | 219/10.55 E |
| 4,841,111 | 6/1989 | Kokkeler et al. | 219/10.55 R |
| 4,870,234 | 9/1989 | Steers et al. | 219/10.55 B |
| 4,870,235 | 9/1989 | Steers et al. | 219/10.55 B |
| 4,871,891 | 10/1989 | Steers et al. | 219/10.55 B |

*Primary Examiner*—Philip H. Leung

*Attorney, Agent, or Firm*—Ernestine C. Bartlett

[57] ABSTRACT

A method and device for determining when a food (9) has thawed in a microwave oven (1) are provided. The food (9) is placed above an element (14) constructed of a microwave sensitive material and shields the element (14) from the microwaves to a different extent according to its degree of thawing. The temperature increase in the material resulting from its absorption of the microwaves is measured by a transducer (18) which receives a signal operationally related to the temperature and which on the basis for the signal halts the thawing when the temperature has reached a suitable value. The element (14) is associated with a food support (8) which thermally isolates it from the food (9), the element being in direct or indirect contact with the transducer (18). The transducer (18) can be disposed either in the food support (8) or in the bottom wall (7) of the oven thawing chamber (4) below the support (8).

15 Claims, 2 Drawing Sheets

METHOD AND DEVICE FOR DETERMINING WHEN A FOOD HAS THAWED IN A MICROWAVE OVEN

FIELD OF THE INVENTION

This invention relates to a method and device for determining when a food has thawed in a microwave oven.

BACKGROUND OF THE INVENTION

To automatically control the thawing of said food, microwave ovens are currently provided with weight sensors which measure the weight variation of the food during said thawing. These sensors are connected to a control member or microprocessor which, based on a prearranged program and the data obtained by the sensor, halts the operation of the microwave generator and consequently the thawing when the weight of the food has attained a predetermined value.

As an alternative to the aforesaid there are microwave ovens provided with infrared sensors which measure the surface temperature of the food. The sensors, connected to a microprocessor, cause the control member to act on the microwave generator and halt its operation when the food surface temperature has reached a predetermined value.

In both cases, a microwave oven as described is costly and laborious to construct. In addition, the data obtained by said sensors do not always reflect the true thawing level attained by the food, particularly with regard to its interior.

SUMMARY OF THE INVENTION

An object of the present invention is to provide a method for controlling the thawing of a food in microwave ovens which is simple to implement, provides proper thawing of all parts of the food and by utilizing the microwave energy enables the temperature attained by the food during this thawing to be measured with good accuracy.

A further object of the present invention is to provide a device for implementing said method which is of simple construction and is easy to install in the oven.

These and further objects which will be apparent to the expert of the art are attained by a method for determining when a food has thawed in a microwave oven, characterised in that the food is placed above an element constructed of a microwave-sensitive material, said food shielding said element from the microwaves to a different extent according to its degree of thawing, the temperature attained by said material by the absorption of said microwaves being measured by transducer means which receive a signal operationally related to said temperature and which on the basis of said signal halt the thawing when said temperature has reached a suitable value.

Said method is implemented by a device characterised in that the element constructed of microwave-sensitive material is associated with a food support which is substantially permeable to the microwaves and thermally isolates the element from the food, said element being in direct or indirect contact with the transducer means.

BRIEF DESCRIPTION OF THE DRAWINGS

The present invention will be more apparent from the accompanying drawing, which is provided by way of non-limiting example only and in which.

DETAILED DESCRIPTION OF PREFERRED EMBODIMENTS

Figure 1:
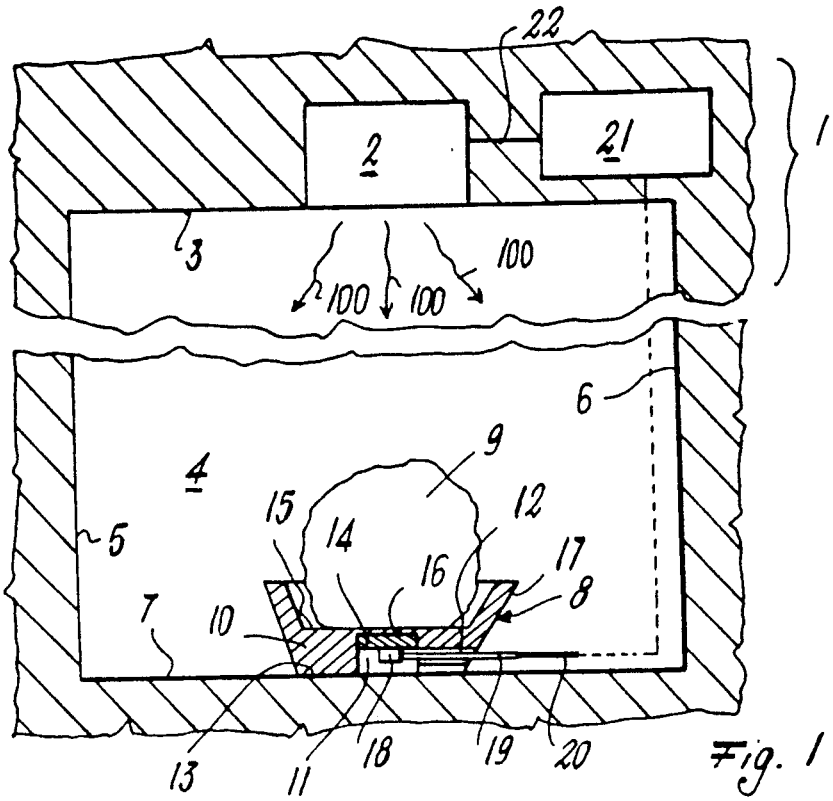
FIG. 1 is a partial diagrammatic section through a microwave oven provided with the device of the present invention.

In FIGS. 1 to 4, a microwave oven indicated overall by the reference numeral 1 comprises a microwave generator or magnetron 2 disposed in the roof 3 of a cooking chamber 4 having side walls 5 and 6 and a bottom wall or base 7.

A support or plate, for example of ceramic, terracotta or the like, for the food 9 rests on the base 7. In the bottom part 10 of the support there are provided (see FIG. 1) two communicating cavities 11 and 12 with their axes mutually orthogonal.

The cavity 11, which opens lowerly into the resting surface 13 of the plate 8, contains an element 14 constructed of microwave-sensitive material (such as ferrite) and forming part of the device according to the invention. This element is not in contact with the food 9, it being separated from the supporting surface 15 of the plate 8 by a separating part 16 and retained in the cavity 11 by known means, such as adhesives.

The cavity 12 extends radially within the bottom part 10 of the plate 8. The cavity 12 opens at one end into a wall 17 of said plate and its other end into the cavity 11 containing the element 14.

A transducer for a signal operationally related to the temperature of the element 14 is associated with said element. In the examples described herein said transducer is a known temperature sensor 18 (also forming, with the element 14, part of the device according to the invention) supported by a hollow rod-shaped element or rod 19. During thawing of the food 9, the sensor 18 is positioned below the element 14 and in contact with it, the rod 19 present in the cavity or corridor 12 projecting at one end from the plate 8. The rod 19 contains the terminal part of an electrical connector 20 for connecting the sensor 18 to a known microprocessor 21 which is able to act on the microwave generator 2 by way of an electrical connection 22.

Figure 6:
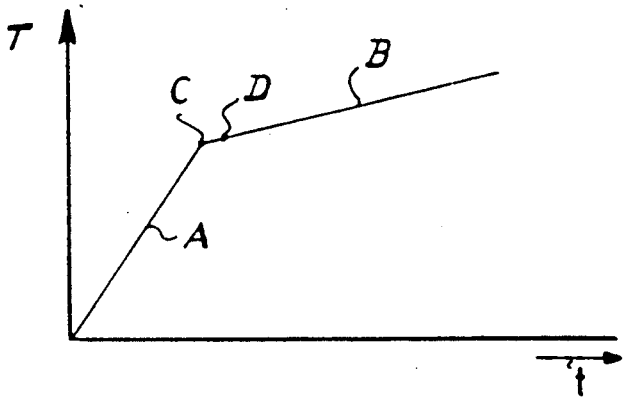
FIG. 6 is a time-temperature curve showing the variation in temperature of a microwave-sensitive element forming part of the device of the invention.

The method of the present invention is described hereinafter in relation to the said device comprising the element 14 of microwave-sensitive material and the sensor 18, and with reference to FIG. 6.

It will be assumed that the food 9 positioned on the plate 8 is to be thawed, for which purposes the magnetron 2 is operated in known manner, for example by means of a pushbutton on the face of the oven 1.

The microwaves generated by said magnetron strike the still frozen food 9, which in this state is permeable to said microwaves. The microwaves therefore reach the element 14 below the food, and which therefore begins to heat up (curve A, FIG. 6).

As the microwaves continue to strike the food 9 they gradually thaw it. As thawing proceeds, the food 9 becomes increasingly more impermeable to the microwaves, which therefore no longer reach the element 14 with the same intensity.

When thawing is complete, most of said microwaves 100 are absorbed by the food 9 with the result that the temperature of said element 14 increases with time at a gradient (curve B, FIG. 6) less than that during the initial stages of thawing.

The sensor 18 in contact with the element 14 continuously measures the temperature variation of said element and feeds signals to the microprocessor 21 through the connection 20. When the temperature gradient of the element 14 changes to that which indicates complete thawing of the food (point C, FIG. 6), the microprocessor 21 acts on the magnetron 2 in accordance with a prearranged program to halt its operation.

In reality, the microprocessor 21 does not act simultaneously with the moment in which the temperature gradient of the element 14 changes (point C, FIG. 6) but later than this at a somewhat higher temperature (such as point D, FIG. 6).

Figure 2:
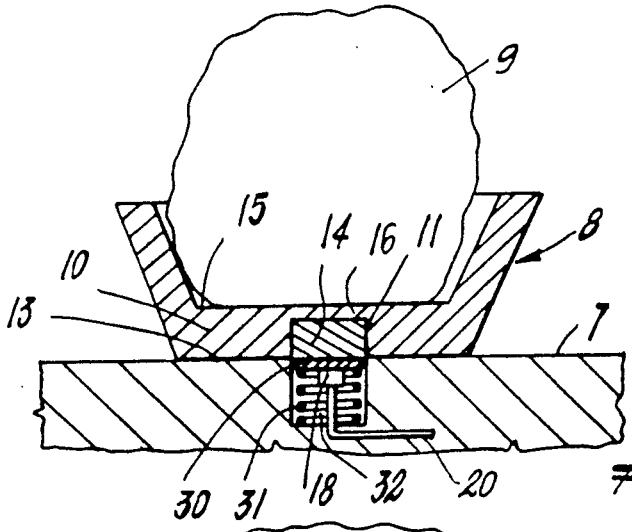
FIG. 2 is a section through a detail of a different embodiment of the device of FIG. 1.

FIG. 2 shows an embodiment of the device according to the invention (comprising the element of microwave-sensitive material and the temperature sensor 18) which differs from that shown in FIG. 1. In FIG. 2 parts identical to those of FIG. 1 are indicated by the same reference numerals.

In the figure under examination, the element 14 of microwave-sensitive material is disposed in the cavity 11 in the plate 8, in a position below the food 9 and is retained in said cavity by known means. The temperature sensor 18 is disposed in the base 7 of the cooking chamber 4 of the oven 1 and is in contact with the element 14 projecting lowerly from said cavity 11. This contact can either be direct, or be indirect as shown in FIG. 2. In this figure the sensor 18 is secured to the underside of a small-thickness metal plate 30, constructed of a heat conducting metal (such as aluminum or cooper). The metal plate 30 is in constant contact with the element 14 by virtue of a spring 31 disposed in a cavity 32 provided in the base 7. In this manner the heat transmitted by conduction from the element 14 of the metal plate 30 is sensed by the sensor 18 and the temperature signal is fed to the microprocessor (not shown in FIG. 2) through the electrical connection 20.

Limit stops (not shown) are provided to prevent the plate 30 escaping from the cavity 32 as a result of the thrust exerted by the spring 31 when the plate 8 is removed. In addition, above the plate 30 in proximity to its edges gaskets of known type (not shown) are provided to prevent foreign matter such as food residues or the like entering the cavity 32 and possibly damaging the sensor 18 or obstructing the action of the spring 31 on the plate 30.

The use of the device shown in FIG. 2 is analogous to that of the device of FIG. 1 and is therefore not further described. It should be noted that the device of FIG. 2 allows th eplate 8 to be easily extracted from the oven 1, for example when it is required to clean the plate. In this respect, with the embodiment of the device shown in FIG. 2 the user in extracting the plate 8 does not have to take into account the presence of the sensor 18 during this operation, as instead he must with the device formed as shown in FIG. 1. With reference to this latter figure the user must extract the rod 19 carrying the sensor 18 from the cavity 12 before he extracts the plate 8 from the oven 1, and this can cause problems particularly of the small space in which the user has to work.

Figure 3:
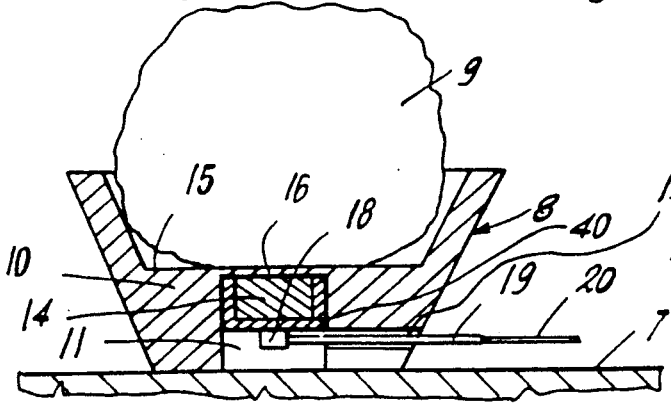
FIG. 3 is a section through a detail of a still further embodiment of the device of FIG. 1.

A further embodiment of the device according to the present invention is shown in FIG. 3. In this figure parts identical to those described in relation to FIGS. 1 and 2 carry the same reference numerals.

In this figure, the element 14 of microwave-sensitive material is inserted into a cup-shaped element 40 which thus surrounds it laterally and lowerly. Said cup-shaped element 40, which is thin-walled, is constructed of microwave-impermeable material (such as copper) having a high heat transfer coefficient. The element 40 therefore acts as a lateral and lower shield for said element 14. In this manner, this latter receives microwaves 100 only from the upper part of the plate 8, i.e. those microwaves which pass through the food 9 while this is still frozen. By virtue of this screening, the reflected microwaves which reach the plate 8 laterally and/or on its underside are not absorbed by the element 14 and do not heat it, this heating being due only to those microwaves which pass through the food 9. This therefore eliminates any spurious effects which could delay the action of the microprocessor 21 on the magnetron 2 when thawing is complete, this action being controlled as stated by the temperature data obtained by the sensor 18 which is positioned in contact with the underside of the cup-shaped element 40.

Figure 4:
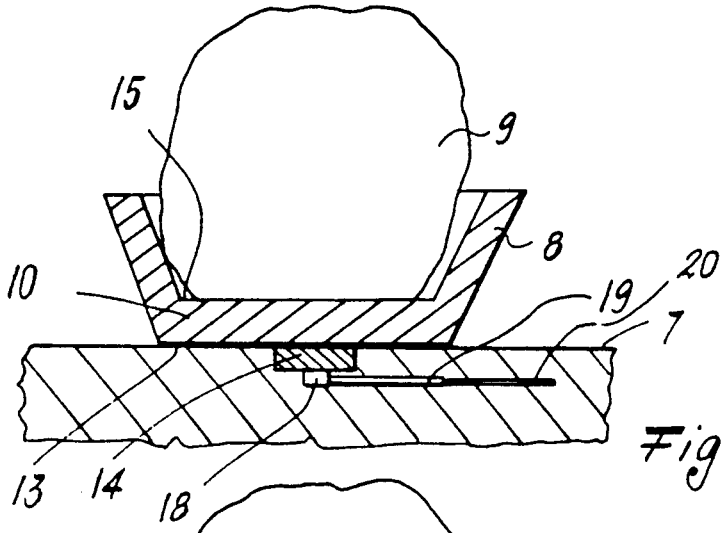
FIG. 4 is a diagrammatic section showing a further embodiment of the device of FIG. 1.
Figure 5:
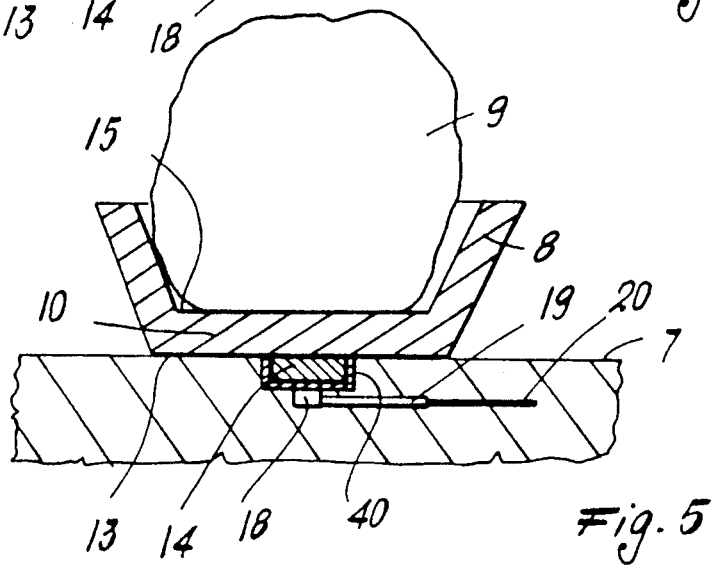
FIG. 5 is a diagrammatic section showing a further embodiment of the device of FIG. 1.

FIGS. 4 and 5 show two further embodiments of the device according to the invention. In these figures parts identical to those described in relation to FIGS. 1, 2 and 3 carry the same reference numerals.

In FIGS. 4 and 5 the element 14 and its associated sensor 18 are both disposed in the base 7 of the cooking chamber 4 and are retained there by known means. In particular, in FIG. 5 the element 14 of microwave-sensitive material is inserted in the cup-shaped element 40 in the same manner and for the same purpose as described in relation to FIG. 3.

The embodiments shown in FIGS. 4 and 5 allow an even simpler construction and use of the device of the present invention. In this respect, with an oven provided with the device of the invention the user is able to use a normal plate 8 instead of having to use a plate suitable only for an oven of the type illustrated in FIGS. 1, 2 and 3. The use of the embodiments of the device shown in FIGS. 4 and 5 is in any event analogous to that described with reference to FIG. 1, and will therefore not be further described.

In the aforegoing description the device of the present invention has been applied to an oven provided with a stationary plate 8. The device can however also be applied to ovens provided with a rotary plate.

In this latter case the transducer or temperature sensor 18 is housed for example in the known rotary shaft (or drive shaft) which supports the plate 8, the shaft for this purpose being made hollow to enable a hollow but stationary shaft to be inserted coaxially into it to carry at its end the sensor 18, which then does not rotate.

In this latter case, the plate 8 can again be of the type described with reference to FIGS. 4 and 5.

Finally, although the transducer 18 associated with the element 14 of microwave-sensitive material has been described herein as a temperature sensor, it can take the form of any transducer able to receive a signal functionally related to the temperature attained by the element 14 in order to generate an electrical signal able to control the operation of the magnetron 2 and thus halt the thawing operation when necessary.

The device of the invention comprising the element 14 of the microwave-sensitive material can also be used to indicate that the magnetron has been set in operation in error, and thus as a warning device indicating that the magnetron 2 is operating without food 9 being present in the oven.

It is well known that such a situation in which the magnetron operates without food 9 being present in the oven 1 can lead to overheating of the microwave generator 2. This is because the generated microwaves are not absorbed by food and are therefore reflected throughout the cooking chamber 4 by its walls to finally return to the magnetron 2, and be absorbed by this latter which consequently heats up.

The presence of the element 14 prevents this. In this respect, because there is no food 9 present to shield the element 14, this latter absorbs a considerable quantity of microwaves in a short period and therefore heats up very rapidly. This rapid heating, sensed by the sensor 18 (and corresponding to a very steep slope of the curve A of FIG. 6), is then calculated by the microprocessor 21, suitably programmed for the purpose, as due to the operation of the magnetron 2 without any food 9 being present in the chamber 4 of the oven 1. At this point the microprocessor then halts the operation of the magnetron 2 before it overheats. Said action of the microprocessor 21 on the microwave generator 2 occurs only a very short time after this latter has been set in operation, and in fact a considerable time before the intervention of the usual temperature sensors provided for halting the operation of the magnetron 2 under such conditions.

The described method and device are simple to implement and construct, and enable the oven to provide optimum and properly controlled food thawing.

What is claimed is:

1. A method for determining when a food has thawed in a microwave oven comprising the steps of placing food (9) in a support (8) in a microwave oven (1) and exposing said food to microwaves generated therein, wherein the food (9) is placed above an element (14) constructed of a microwave-sensitive material, said food (9) sheilding said element (14) from the microwaves to a different extent according to its degree of thawing, the temperature attained by said material by the absorption of said microwaves being measured by transducer means (18) which receive a signal operationally related to said temperature and which on the basis of said signal halt the thawing when said temperature has reached a suitable value.

2. A device for determining when a food has thawed in a microwave oven, said device comprising a microwave oven (1) having a bottom wall (7), a cooking chamber (4) and a microwave generator (2), a support (8) for food (9) to be thawed therein, the support including at least one cavity, an element (14) constructed of a microwave-sensitive material, and transducer means (18) which receive a signal operationally related to the temperature attained by said element (14) and which on the basis of said signal is effective to halt the thawing when the temperature has reached a suitable value, said element (14) being situated in a cavity of the support (8) which thermally isolates the element from the food (9), said element being in direct or indirect contact with the transducer means (18).

3. A device as claimed in claim 2, wherein the element (14) of microwave-sensitive material is inserted in a cavity (11) provided in the food support (8).

4. A device as claimed in claim 3, wherein the element (14) of microwave-sensitive material occupies the entire volume of the cavity (11) in the support (8) for the food (9), said element (14) cooperating with transducer means (18) contained in the bottom wall (7) of the cooking chamber (4) of the oven (1).

5. A device as claimed in claim 4, wherein the element (14) of microwave-sensitive material is in contact with a metal plate (30) urged by a spring (31) with on the transducer means (18), said metal plate (30) being axially mobile in a cavity (32) provided in the bottom wall (7) of the cooking chamber (4).

6. A device as claimed in claim 2, wherein the transducer means (18) are in contact with the element (14) in the cavity (11), said transducer means (18) being connected a rod-shaped member (19) inserted through a radial cavity (12) in the support (8) for the food (9).

7. A device as claimed in claim 2, wherein the element (14) of microwave-sensitive material is screened by a microwave-impermeable material.

8. A device as claimed in claim 7, wherein the element (14) of microwave-sensitive material is contained in a cup-shaped element (40) .

9. A device as claimed in claim 2, wherein the element (14) of micorwave-sensitive material and the transducer means (18) are formed integral with the bottom wall (7) of the cooking chmaber (4) of the oven (1).

10. A device as claimed in claim 2, wherein the transducer means (18) are connected to a microprocessor (12) arranged to interrupt operation of the microwave generator.

11. A device as claimed in claim 10, wherein the microprocessor (21) is programmed in such a manner as to act on the microwave generator (2) so as to halt it when this latter is set into operation when no food (9) is present in the cooking chamber (4) of the oven (1).

12. A device as claimed in claim 2, wherein the transducer means are a temperature sensor (18).

13. A device as claimed in claim 2, wherein the support (8) for the food (9) is stationary.

14. A device as claimed in claim 2, further comprising means for rotating the support (8), said support (8) for the food (9) being of rotary type.

15. A device as claimed in claim 14, wherein the transducer means (18) are disposed within a cavity provided in a used drive shaft used for rotating the support (8) for the food (9), said transducer means (18) cooperating with the element (14) of microwave-sensitive material which is also disposed in the drive shaft cavity.

* * * * *